US010989372B2

(12) United States Patent
Meir et al.

(10) Patent No.: US 10,989,372 B2
(45) Date of Patent: Apr. 27, 2021

(54) FIXTURES AND LIGHTING ACCESSORIES FOR LIGHTING DEVICES

(71) Applicant: Ecosense Lighting Inc., Los Angeles, CA (US)

(72) Inventors: Ariel Meir, Brooklyn, NY (US); Rina Meir, Brooklyn, NY (US); Noam Meir, Herzliya (IL); Niv Sadeh, Hod Hasharon (IL)

(73) Assignee: ECOSENSE LIGHTING INC., Los Angeles, CA (US)

( * ) Notice: Subject to any disclaimer, the term of this patent is extended or adjusted under 35 U.S.C. 154(b) by 0 days.

(21) Appl. No.: 16/728,596

(22) Filed: Dec. 27, 2019

(65) Prior Publication Data

US 2020/0158299 A1 May 21, 2020

Related U.S. Application Data

(63) Continuation of application No. 15/917,481, filed on Mar. 9, 2018, now abandoned.
(Continued)

(51) Int. Cl.
*F21V 21/00* (2006.01)
*F21S 4/10* (2016.01)
(Continued)

(52) U.S. Cl.
CPC . *F21S 4/10* (2016.01); *F21S 2/00* (2013.01); *F21S 4/28* (2016.01); *F21V 5/007* (2013.01);
(Continued)

(58) Field of Classification Search
CPC ..... F21S 4/10; F21S 4/28; F21S 2/00; F21S 5/007; F21S 17/02; F21S 21/02; F21S 11/18; F21S 11/06; H05B 45/20
(Continued)

(56) References Cited

U.S. PATENT DOCUMENTS 4,445,164 A 4/1984 Giles, III et al.
4,580,859 A 4/1986 Frano et al.
(Continued)

FOREIGN PATENT DOCUMENTS

CA 2623604 A 8/2009
CN 101592291 A 12/2009
(Continued)

OTHER PUBLICATIONS

PCT/US2012/060588, International Application Serial No. PCT/US2012/060588, International Search Report and Written Opinion dated Mar. 29, 2013, Ecosense Lighting Inc. et al, 10 pages.
(Continued)

*Primary Examiner* — Laura K Tso
(74) *Attorney, Agent, or Firm* — Jay M. Brown

(57) ABSTRACT

According to at least one aspect, a lighting system is provided. The lighting system comprises a strip lighting device including a circuit board, a light emitting diode (LED) mounted to the circuit board, a lens disposed over the LED and configured to receive the light emitted from the LED and change at least one characteristic of the light received from the LED, and an elastomer encapsulating at least part of the circuit board. The lighting system further comprises a fixture configured to receive the strip lighting device and mount to a structure and a lighting accessory configured to removably couple to the fixture over the strip lighting device and change at least one characteristic of the light from the strip lighting device.

20 Claims, 12 Drawing Sheets

Related U.S. Application Data

(60) Provisional application No. 62/469,358, filed on Mar. 9, 2017.

(51) Int. Cl.

| | |
|---|---|
| ***F21V 21/02*** | (2006.01) |
| ***F21V 5/00*** | (2018.01) |
| ***F21S 4/28*** | (2016.01) |
| ***F21S 2/00*** | (2016.01) |
| ***F21V 17/02*** | (2006.01) |
| *F21Y 103/10* | (2016.01) |
| *F21V 11/06* | (2006.01) |
| *F21V 11/18* | (2006.01) |
| *F21Y 115/10* | (2016.01) |
| *H05B 45/20* | (2020.01) |

(52) U.S. Cl.
CPC ..... *F21V 17/02* (2013.01); *F21V 21/02* (2013.01); *F21V 11/06* (2013.01); *F21V 11/18* (2013.01); *F21Y 2103/10* (2016.08); *F21Y 2115/10* (2016.08); *H05B 45/20* (2020.01)

(58) Field of Classification Search
USPC ..... 362/311.02, 249.02, 217.1, 217.12, 362/217.13, 217.02, 220, 321, 322, 325, 362/342
See application file for complete search history.

(56) References Cited

U.S. PATENT DOCUMENTS 4,727,648 A 3/1988 Savage
4,837,927 A 6/1989 Savage
5,087,212 A 2/1992 Hanami
5,174,649 A 12/1992 Alston
5,387,901 A 2/1995 Hardt
5,436,809 A 6/1995 Brassier et al.
5,450,664 A 9/1995 Babow et al.
5,490,048 A 2/1996 Brassier et al.
5,628,557 A 5/1997 Huang
5,632,551 A 5/1997 Roney et al.
5,658,066 A 8/1997 Hirsch
5,821,695 A 10/1998 Vilanilam
6,354,714 B1 3/2002 Rhodes
6,426,704 B1 6/2002 Hutchison
6,439,743 B1 8/2002 Hutchison
6,450,662 B1 9/2002 Hutchison
6,473,002 B1 10/2002 Hutchison
6,474,839 B1 11/2002 Hutchison
6,527,422 B1 3/2003 Hutchison
6,530,674 B2 3/2003 Grierson et al.
6,590,235 B2 7/2003 Carey
6,601,970 B2 8/2003 Ueda et al.
6,676,284 B1 1/2004 Wynne
6,773,138 B2 8/2004 Coushaine
6,824,296 B2 11/2004 Souza et al.
6,827,469 B2 12/2004 Coushaine et al.
6,880,952 B2 4/2005 Kiraly et al.
6,893,144 B2 5/2005 Fan
6,979,097 B2 12/2005 Elam et al.
7,093,958 B2 8/2006 Coushaine
7,132,804 B2 11/2006 Lys et al.
7,150,553 B2 12/2006 English et al.
7,159,997 B2 1/2007 Reo et al.
7,161,311 B2 1/2007 Mueller et al.
7,210,957 B2 5/2007 Mrakovich et al.
7,221,104 B2 5/2007 Lys et al.
7,229,192 B2 6/2007 Mayfield et al.
7,261,435 B2 8/2007 Gould et al.
7,267,461 B2 9/2007 Kan et al.
7,360,925 B2 4/2008 Coushaine
7,414,269 B2 8/2008 Grotsch
7,455,422 B2 11/2008 Gould et al.
7,481,552 B2 1/2009 Mayfield et al.
7,481,566 B2 * 1/2009 Han ..... G02B 6/0025 362/342
7,530,716 B2 5/2009 Mayfield et al.
7,540,761 B2 6/2009 Weber et al.
7,549,786 B2 6/2009 Higley et al.
7,575,332 B2 8/2009 Cok
7,595,113 B2 9/2009 Miyoshi
7,604,365 B2 10/2009 Chang
7,654,703 B2 2/2010 Kan et al.
7,700,965 B2 4/2010 Chang
7,703,951 B2 4/2010 Piepgras et al.
7,712,926 B2 5/2010 Matheson
7,727,009 B2 6/2010 Goto
7,731,396 B2 6/2010 Fay et al.
7,744,266 B2 6/2010 Higley et al.
7,766,518 B2 8/2010 Piepgras et al.
7,806,562 B2 10/2010 Behr et al.
7,810,955 B2 10/2010 Stimac et al.
7,810,995 B2 10/2010 Fadler et al.
7,841,753 B2 11/2010 Liu
7,857,482 B2 12/2010 Reo et al.
7,866,847 B2 * 1/2011 Zheng ..... F21S 2/005 362/249.03
7,878,683 B2 2/2011 Logan et al.
7,918,589 B2 4/2011 Mayfield et al.
7,922,364 B2 4/2011 Tessnow et al.
7,923,907 B2 4/2011 Tessnow et al.
7,952,114 B2 5/2011 Gingrich, III et al.
7,961,113 B2 6/2011 Rabiner et al.
7,972,038 B2 6/2011 Albright et al.
7,988,336 B1 8/2011 Harbers et al.
7,997,758 B2 * 8/2011 Zhang ..... F21K 9/00 362/235
8,033,680 B2 10/2011 Sharrah et al.
8,052,310 B2 11/2011 Gingrich, III et al.
8,066,403 B2 11/2011 Sanfilippo et al.
8,076,683 B2 12/2011 Xu
8,113,680 B2 2/2012 O'Brien et al.
8,154,864 B1 4/2012 Nearman et al.
8,172,436 B2 5/2012 Coleman et al.
8,207,546 B2 6/2012 Harada
8,262,250 B2 9/2012 Li
8,297,788 B2 10/2012 Bishop
8,314,566 B2 11/2012 Steele
3,434,897 A1 5/2013 Logan et al.
8,434,898 B2 5/2013 Sanfilippo et al.
8,454,193 B2 6/2013 Simon et al.
8,545,045 B2 10/2013 Tress
8,575,646 B1 11/2013 Shum
8,616,720 B2 12/2013 Carney et al.
8,702,265 B2 4/2014 May
8,748,202 B2 6/2014 Kwon
8,764,220 B2 7/2014 Chan et al.
8,791,485 B2 7/2014 Ohbayashi
8,820,964 B2 9/2014 Gould
8,876,322 B2 11/2014 Alexander
8,876,325 B2 11/2014 Lu et al.
8,998,448 B2 * 4/2015 Chang ..... F21V 5/00 362/246
9,016,895 B2 4/2015 Handsaker
9,052,075 B2 6/2015 Demuynck et al.
9,157,622 B2 10/2015 Yanping
9,188,290 B2 11/2015 Lay et al.
9,285,085 B2 3/2016 Carney et al.
9,518,706 B2 12/2016 Chan et al.
9,605,812 B2 3/2017 Van De Ven et al.
9,651,227 B2 5/2017 Pickard et al.
9,666,772 B2 5/2017 Ibbetson
9,722,158 B2 8/2017 Chan et al.
9,874,333 B2 1/2018 Lay et al.
9,976,710 B2 5/2018 Meir
9,995,444 B2 6/2018 Leichner
10,030,828 B2 7/2018 Meir
10,100,988 B2 10/2018 Rodgers et al.
10,228,099 B2 3/2019 Meir
10,378,705 B2 8/2019 Meir
10,465,864 B2 11/2019 Leichner
10,584,860 B2 3/2020 Dungan et al.
10,612,747 B2 4/2020 Rodgers et al.

(56) References Cited

U.S. PATENT DOCUMENTS

2002/0117692 A1 8/2002 Lin
2003/0058658 A1 3/2003 Lee
2003/0072156 A1 4/2003 Pohlert et al.
2003/0198049 A1 10/2003 Hulse
2005/0092517 A1 5/2005 Fan
2005/0280016 A1 12/2005 Mok
2005/0286265 A1 12/2005 Zampini et al.
2006/0134440 A1 6/2006 Crivello
2006/0141851 A1 6/2006 Matsui et al.
2006/0146531 A1 7/2006 Reo et al.
2007/0064428 A1 3/2007 Beauchamp
2007/0092736 A1 4/2007 Boardman
2007/0103902 A1 5/2007 Hsiao
2007/0205425 A1 9/2007 Harada
2008/0080196 A1 4/2008 Ruud
2008/0144322 A1 6/2008 Norfidathul
2008/0165530 A1 7/2008 Hendrikus
2008/0244944 A1 10/2008 Nall
2008/0298058 A1 12/2008 Kan et al.
2009/0021936 A1 1/2009 Stimac et al.
2009/0167203 A1 7/2009 Dahlman et al.
2009/0195168 A1 8/2009 Greenfield
2009/0225546 A1 9/2009 Pearson
2009/0272996 A1 11/2009 Chakraborty
2009/0310354 A1 12/2009 Zampini et al.
2009/0321766 A1 12/2009 Chang
2010/0008090 A1 1/2010 Li
2010/0033948 A1 2/2010 Harbers et al.
2010/0060202 A1 3/2010 Melanson et al.
2010/0246179 A1 9/2010 Long et al.
2011/0013387 A1 1/2011 Kanade et al.
2011/0051407 A1 3/2011 Stes, IV et al.
2011/0062470 A1 3/2011 Bierhuizen
2011/0122643 A1 5/2011 Spark et al.
2011/0134634 A1 6/2011 Gingrich, III et al.
2011/0136374 A1 6/2011 Mostoller et al.
2011/0193490 A1 8/2011 Kumar
2011/0198067 A1 8/2011 Hada
2011/0210364 A1 9/2011 Nolan
2011/0222270 A1 9/2011 Porciatti
2011/0255287 A1 10/2011 Li
2011/0280020 A1* 11/2011 Chen ..... F21V 31/005 362/294
2012/0002417 A1 1/2012 Li
2012/0025241 A1 2/2012 Xiao
2012/0025729 A1 2/2012 Melanson et al.
2012/0051048 A1 3/2012 Smit et al.
2012/0051056 A1 3/2012 Derks et al.
2012/0051068 A1 3/2012 Pelton et al.
2012/0106152 A1 5/2012 Zheng et al.
2012/0140474 A1 6/2012 Jurik et al.
2012/0250309 A1* 10/2012 Handsaker ..... F21V 5/04 362/235
2013/0063939 A1 3/2013 Kondo
2013/0083524 A1* 4/2013 Devorris ..... F21V 31/04 362/235
2013/0134445 A1 5/2013 Tarsa
2013/0214691 A1 8/2013 Chen
2013/0272000 A1 10/2013 Pearson
2014/0001952 A1 1/2014 Harris et al.
2014/0036500 A1 2/2014 Eggleton
2014/0043812 A1* 2/2014 Moreau ..... F21V 5/04 362/240
2014/0176016 A1 6/2014 Li et al.
2014/0177262 A1 6/2014 Lai
2014/0268720 A1 9/2014 Dungan et al.
2014/0268748 A1 9/2014 Lay et al.
2014/0334142 A1 11/2014 Levante
2015/0117022 A1 4/2015 Meir
2015/0252982 A1 9/2015 Demuynck et al.
2015/0316219 A1 11/2015 Mallory
2016/0003424 A1 1/2016 Wu
2016/0035944 A1 2/2016 Spanard
2016/0076743 A1* 3/2016 Deutsch ..... F21V 7/0091 362/268
2016/0195225 A1 7/2016 Carney et al.
2016/0327249 A1 11/2016 Pearson
2016/0327256 A1 11/2016 Hall
2017/0009957 A1 1/2017 Lim et al.
2017/0261186 A1 9/2017 Meir
2017/0261187 A1 9/2017 Meir
2019/0219251 A1 7/2019 Meir
2019/0383450 A1 12/2019 Meir
2020/0096178 A1 3/2020 Aviram
2020/0141546 A1 5/2020 Meir
2020/0144468 A1 5/2020 Meir
2020/0191370 A1 6/2020 Shohat

FOREIGN PATENT DOCUMENTS

CN 201590432 U 9/2010
CN 201739849 U 2/2011
CN 101997074 A 3/2011
CN 202040752 U 11/2011
CN 102269351 A 12/2011
EP 0592746 B1 3/1997
EP 2474775 B1 11/2013
EP 2256833 B1 4/2014
EP 2484956 B1 6/2014
GB 2457016 A 8/2009
JP 2011508406 T 3/2011
JP 2011204495 A 10/2011
JP 2011204658 A 10/2011
KR 1020070039683 A 4/2007
KR 20090013704 A 2/2009
KR 100974942 B1 8/2010
KR 1020120050280 A 5/2012
KR 1020110106033 A 6/2013
WO 2002015281 A2 2/2002
WO 2013059298 A1 4/2013
WO 2014082262 A1 5/2014
WO 2014099681 A2 6/2014
WO 2014099681 A3 12/2014
WO 2015066184 A1 5/2015
WO 2019213299 A1 11/2019

OTHER PUBLICATIONS

PCT/US2012/060588, "International Application Serial No. PCT/US2012/060588, International Preliminary Report on Patentability and Written Opinion dated May 1, 2014", Ecosense Lighting Inc. et al, 7 Pages.
PCT/U52013/075172, "International Application Serial No. PCT/US2013/075172, International Search Report and Written Opinion dated Sep. 26, 2014", Ecosense Lighting Inc., 16 Pages.
International Search Report and Written Opinion dated Nov. 27, 2013 in PCT Application No. PCT/US2013/045708.
PCT/US2014/062905, International Preliminary Report on Patentability dated May 3, 2016 (7 pp).
PCT/US2014/062905, Written Opinion of the Int'l Searching Authority dated Jan. 22, 2015 (6 pp).

* cited by examiner

FIXTURES AND LIGHTING ACCESSORIES FOR LIGHTING DEVICES

CROSS-REFERENCE TO RELATED APPLICATIONS

This application is a continuation of U.S. application Ser. No. 15/917,481, filed Mar. 9, 2018, which claims the benefit under 35 U.S.C. § 119(e) of U.S. Provisional Application Ser. No. 62/469,358, filed Mar. 9, 2017, which are hereby incorporated herein by reference in their entirety.

BACKGROUND

Light emitting diodes (LEDs) are typically formed from a semiconductor material that is doped to create a p-n junction. The LEDs typically emit light in a narrow spectrum (e.g., a spectrum that is smaller 100 nanometers in size) that is dependent upon the bandgap energy of the semiconductor material that forms the p-n junction. For example, an LED formed using one semiconductor material may emit light of a different color (and thereby in a different spectrum) than an LED formed using another semiconductor material.

White light has a broad spectrum (e.g., a spectrum that is larger than 200 nanometers in size), unlike the light typically emitted from an LED. White light may be formed by mixing light with different colors (and thereby different spectrums) together. For example, white light may be formed by mixing red, green, and blue light or blue and yellow light. Inexpensive LEDs that create white light (a white LED) typically use an LED configured to emit blue light (a blue LED) that is coated with a yellow phosphor. The yellow phosphor coating converts a portion of the blue light from the LED into yellow light. The mixture of the blue and yellow light forms white light.

SUMMARY

According to at least one aspect, a lighting system is provided. The lighting system comprises a strip lighting device including a circuit board, a light emitting diode (LED) mounted to the circuit board, a lens disposed over the LED and configured to receive the light emitted from the LED and change at least one characteristic of the light received from the LED, and an elastomer encapsulating at least part of the circuit board. The lighting system further comprises a fixture configured to receive the strip lighting device and mount to a structure and a lighting accessory configured to removably couple to the fixture over the strip lighting device and change at least one characteristic of the light from the strip lighting device.

In some embodiments, the lens disposed over the LED is configured to change at least one characteristic selected from the group consisting of: a color temperature, an angular correlated color temperature deviation, and a light distribution pattern. In some embodiments, the lighting accessory is configured to change at least one characteristic selected from the group consisting of: a color temperature and a light distribution pattern.

In some embodiments, the fixture is configured to mount to a ceiling, an interior wall, an exterior wall, a floor, or a railing. In some embodiments, the fixture comprises a metal such as aluminum. In some embodiments, the lighting accessory comprises a light filter configured to change a color temperature of the light from the strip lighting device. In some embodiments, the light filter comprises a pigmented elastomer.

In some embodiments, the lighting accessory comprises a light louver configured to change a distribution of light from the strip lighting device. In some embodiments, the light louver has a hexagonal pattern. In some embodiments, the light louver has a rectangular pattern. In some embodiments, the light lover is configured to removably couple to the fixture using at least one magnet.

In some embodiments, the lighting accessory comprises a barn door assembly configured to change a distribution of light from the strip lighting device. In some embodiments, the barn door assembly comprises a plurality of barn doors each rotatably coupled to the fixture.

In some embodiments, the lighting accessory comprises a mirror assembly configured to change a distribution of light from the strip lighting device. In some embodiments, the mirror assembly comprises a mirror that is configured to rotate about at least a first axis to change the distribution of light from the strip lighting device. In some embodiments, the mirror is configured to rotate about a second axis that is parallel to the first axis.

In some embodiments, the fixture comprises a tray having a surface to receive the strip lighting device and a plurality of sidewalls that at least partially capture the strip lighting device within the tray. In some embodiments, the strip lighting device comprises an adhesive that is configured to stick to the surface of the tray to receive the strip lighting device. In some embodiments, at least one of the plurality of sidewalls comprises a rail to removably couple to the lighting accessory.

In some embodiments, the strip lighting device has a length (e.g., approximately six inches), a width that is less than the length (e.g., approximately one inch), and a height that is less than the width (e.g., approximately half an inch). In some embodiments, the strip lighting device comprises a plurality of LED that are spaced along the length of the strip lighting device (e.g., the LEDs may be spaced apart by approximately one inch).

According to at least one aspect, a lighting system is provided. The lighting system comprises a strip lighting device comprising a circuit board, a light emitting diode (LED) mounted to the circuit board, a lens disposed over the LED and configured to receive the light emitted from the LED and change at least one characteristic of the light received from the LED, and an elastomer encapsulating at least part of the circuit board without being in contact with at least part of the lens. The lighting system further comprises a fixture configured to receive the strip lighting device and mount to a structure.

In some embodiments, the fixture is configured to be mounted in a wall and fixture comprises at least one flange to hold the fixture in the wall. In some embodiments, the fixture comprises a stationary member coupled to the flange and configured to receive a rotating member. In some embodiments, the rotating member is configured to rotate along an interface between the rotating member and the stationary member. In some embodiments, the rotating member is configured to receive the strip lighting device.

According to at least one aspect, a lighting system is provided. The lighting system comprises a strip lighting device comprising a tray, a circuit board disposed in the tray, a light emitting diode (LED) mounted to the circuit board, and an elastomer encapsulating at least part of the circuit board and being in contact with the tray; a fixture configured to receive the strip lighting device and mount to a structure, the fixture comprising a tray including a surface to receive the strip lighting device and a plurality of sidewalls that at least partially capture the strip lighting device within the tray; and a lighting accessory configured to removably couple to the fixture over the strip lighting device and change at least one characteristic of the light from the strip lighting device.

In some embodiments, the strip lighting device has a height of no more than approximately one inch, a width of no more than approximately 3 inches, and a length of no more than approximately 6 inches.

In some embodiments, the strip lighting device comprises a lens assembly disposed over the LED and configured to change at least one characteristic of the light from the LED.

In some embodiments, the lighting system further comprises a lens assembly including at least one lenticular lens disposed above the strip lighting device and configured to change at least one characteristic of light from the strip lighting device. In some embodiments, the tray includes a notch on an outer lateral surface of the tray and wherein the lens assembly is configured to removably couple to the strip lighting device using the notch.

In some embodiments, the lighting accessory is configured to change at least one characteristic selected from the group consisting of: a color temperature and a light distribution pattern.

In some embodiments, the fixture is configured to mount to a ceiling, an interior wall, an exterior wall, a floor, or a railing.

In some embodiments, the lighting accessory comprises a light filter configured to change a color temperature of the light from the strip lighting device. In some embodiments, the light filter comprises a pigmented elastomer.

In some embodiments, the lighting accessory comprises a light louver configured to change a distribution of light from the strip lighting device. In some embodiments, the light louver has a hexagonal pattern or a rectangular pattern.

In some embodiments, the lighting accessory comprises a barn door assembly configured to change a distribution of light from the strip lighting device and including a plurality of barn doors rotatably coupled to the fixture.

In some embodiments, the lighting accessory comprises a mirror assembly configured to change a distribution of light from the strip lighting device and including a mirror that is configured to rotate about at least one axis to change the distribution of light from the strip lighting device.

In some embodiments, the tray comprises a rail that extends from at least one of the plurality of sidewalls and configured to removably couple to the lighting accessory.

According to at least one aspect, a lighting system is provided. The lighting system comprises a strip lighting device comprising a tray, a circuit board disposed in the tray, a light emitting diode (LED) mounted to the circuit board, a lens assembly disposed above the circuit and an elastomer encapsulating at least part of the circuit board and being in contact with the tray; and a fixture configured to receive the strip lighting device and be mounted in a wall, the fixture comprising at least one flange to hold the fixture in the wall, a stationary member coupled to the flange, and a rotating member that is configured to receive the strip lighting device and rotate along an interface between the rotating member and the stationary member.

In some embodiments, the lighting system further comprises a lighting accessory configured to removably couple to the fixture over the strip lighting device and change at least one characteristic of the light from the strip lighting device.

According to at least one aspect, a lighting system is provided. The lighting system comprises a strip lighting device comprising a tray, a circuit board disposed in the tray, a light emitting diode (LED) mounted to the circuit board, a first lens assembly disposed above the LED and configured to change at least one characteristic of light from the LED, and an elastomer encapsulating at least part of the circuit board and being in contact with the tray and the lens assembly; and a second lens assembly comprising at least one lenticular lens disposed above the strip lighting device and configured to change at least one characteristic of light from the lighting device.

In some embodiments, the tray includes a notch on an outer lateral surface of the tray and wherein the lens assembly is configured to removably couple to the strip lighting device using the notch. In some embodiments, the second lens assembly comprises: a top portion that is disposed above the first lens assembly and including the at least one lenticular lens; a sidewall that extends from the top portion and has an inner surface that faces the outer lateral surface of the tray and an outer surface that faces away from the outer lateral surface of the tray; and a protrusion on the sidewall that is configured to engage the notch on the outer lateral surface of the tray.

In some embodiments, the second lens assembly is coupled to a top surface of the strip lighting device.

BRIEF DESCRIPTION OF THE DRAWINGS

Various aspects and embodiments will be described with reference to the following figures. It should be appreciated that the figures are not necessarily drawn to scale. In the drawings, each identical or nearly identical component that is illustrated in various figures is represented by a like numeral. For purposes of clarity, not every component may be labeled in every drawing.

DETAILED DESCRIPTION

Figure 1A:
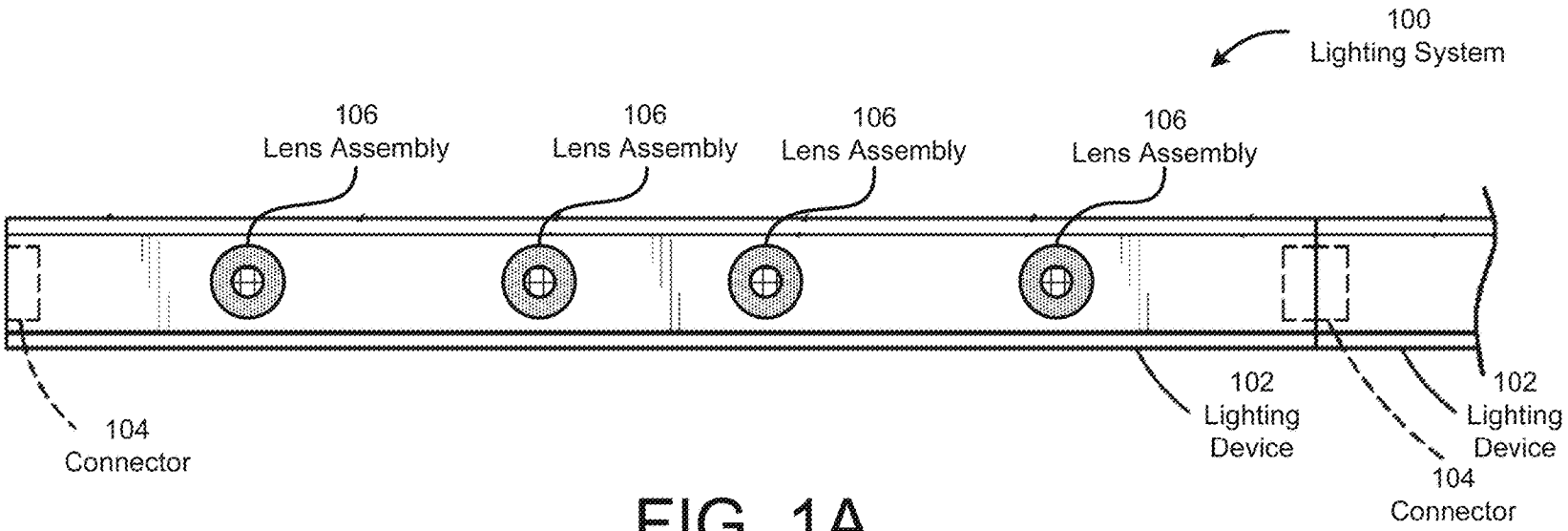
FIG. 1A shows a top view of an example lighting system, according to some embodiments of the technology described herein.

As discussed above, inexpensive white light emitting diodes (LEDs) generally are constructed as white phosphor-converted LEDs where a blue LED is covered with a phosphor coating that converts a portion of the blue light from the LED to yellow light so as to create white light. Conventional lighting devices are typically constructed with a set of such white LEDs (all with the same construction) that are connected to a common power source.

The inventors have that such conventional lighting devices are generally only able to emit light with a single, fixed set of characteristics (e.g., light distribution, color correlated temperature (CCT) value, color, etc.). While such conventional LED strip lighting devices may be suitable for hobbyist use, commercial establishments may have different demands. Commercial establishments may want to customize the light distribution, CCT, and/or color of the light from the lighting device.

Accordingly, aspects of the present disclosure relate to lighting accessories that are configured to change at least one characteristic of the light from the lighting device. In some embodiments, a lighting system may be provided that comprises a strip lighting device, a fixture into which the lighting device may be disposed and/or mounted, and a lighting accessory that is configured to removably couple to the lighting fixture over the strip lighting device and change at least one characteristic of the light from the strip lighting device. Thus, the characteristics of the light from the strip lighting device may be customized to suit any of a variety of situations by coupling different lighting accessories to the fixture.

In some embodiments, the strip lighting device may comprise a tray with a base and a plurality of sidewalls that extend from the base (e.g., extend in a direction that is perpendicular to the base), a circuit board disposed in the tray (e.g., disposed and/or mounted to a surface of the base of the tray), an LED mounted to the circuit board, and an elastomer (e.g., silicone, rubber, etc.) encapsulating at least part of the circuit board and being in contact with the tray. In these embodiments, the strip lighting device may further comprise a lens assembly that is disposed above the LED and configured to change at least one characteristic of the light from the LED. The lens assembly may comprise at least one optical element such as a lens, a reflector, and/or a light scattering element. For example, the lens assembly may comprise only a lens. In another example, the lens assembly may comprise a lens and a reflector. The lens assembly may be attached to the strip lighting device via the circuit board (e.g., the lens assembly may be mounted to the circuit board) and/or the elastomer that at least partially encapsulates the circuit board (e.g., the elastomer may be in direct contact with at least part of the lens assembly). The strip lighting device may be designed to have any of a variety of dimensions. For example, the strip lighting device may a length of no more than approximately 6 inches, a width of no more than approximately 3 inches, and a height of no more than approximately ⅝ inches.

In some embodiments, the fixture may be configured to receive the strip lighting device and mount to a structure. The structure may be, for example, a ceiling, an interior wall, an exterior wall, a floor, or a railing. The fixture may be constructed from a metal such as aluminum, brass, copper, steel, and iron (or any combination thereof). The fixture may comprise a tray including a surface to receive the strip lighting device and a plurality of sidewalls that at least partially capture the strip lighting device within the tray. The tray may further include a rail disposed on at least one of the sidewalls and configured to removably couple to the lighting accessory.

In some embodiments, the lighting accessory may be configured to removably couple to the fixture over the strip lighting device and change at least one characteristic of the light (e.g., distribution, CCT value, and/or color) from the strip lighting device. The lighting accessory may be implemented in any of a variety of ways. For example, the lighting accessory may comprise a light filter (e.g., implemented as a pigmented elastomer) configured to change a CCT value of the light from the strip lighting device. In another example, the lighting accessory comprises a light louver configured to change a distribution of light from the strip lighting device. In yet another example, the lighting accessory comprises a barn door assembly configured to change a distribution of light from the strip lighting device and including a plurality of barn doors rotatably coupled to the fixture. In still yet another example, the lighting accessor comprises a mirror assembly configured to change a distribution of light from the strip lighting device and including a mirror that is configured to rotate about at least one axis to change the distribution of light from the strip lighting device.

It should be appreciated that the embodiments described herein may be implemented in any of numerous ways. Examples of specific implementations are provided below for illustrative purposes only. It should be appreciated that these embodiments and the features/capabilities provided may be used individually, all together, or in any combination of two or more, as aspects of the technology described herein are not limited in this respect.

Example Lighting Systems

Figure 1B:
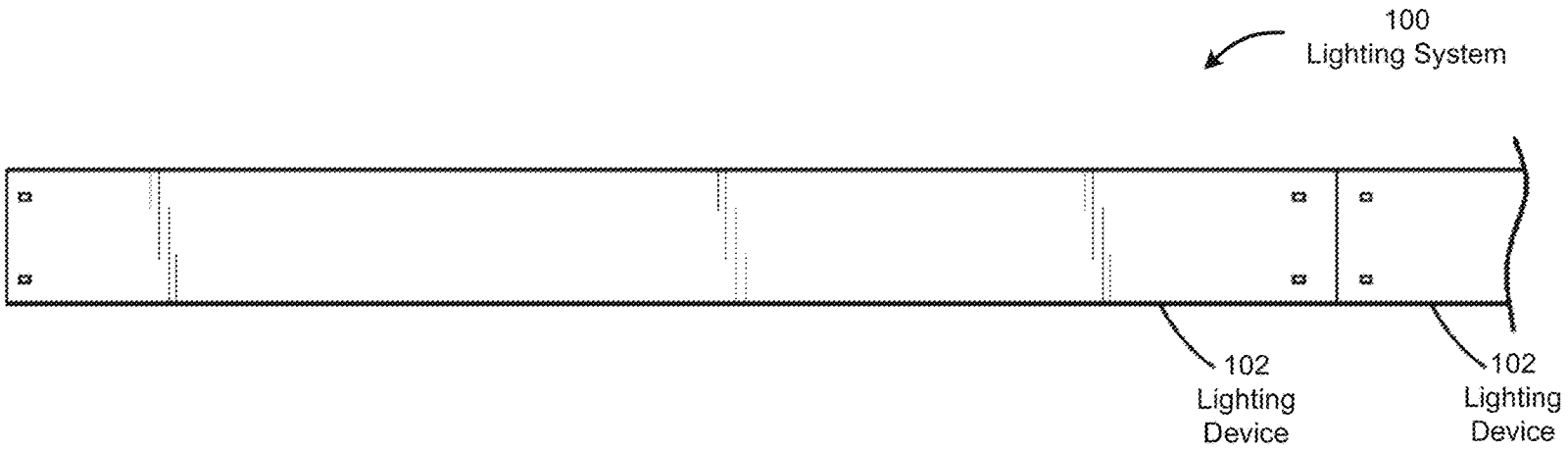
FIG. 1B shows a bottom view of the example lighting system of FIG. 1A, according to some embodiments of the technology described herein.

FIGS. 1A and 1B show top and bottom views, respectively, of an example lighting system 100. As shown, the lighting system 100 is constructed as a strip lighting system that comprises a plurality of electrically coupled lighting devices 102. Thereby, the length of the lighting system 100 may be customized by adding (or removing) lighting devices 102. Each of the lighting devices 102 may comprise LEDs that are electrically coupled to a connector 104. In turn, the connector 104 may electrically couple to an external device such as another lighting device 102 or a power adapter. The LEDs may receive power from the external device via the connector 104 and emit light. The connector 104 may be implemented as a male or female connectors as shown below in FIGS. 2A and 2B. It should be appreciated that the lighting system 100 may comprise, for example, a fixture (not shown) to mount the lighting device 102 to a structure such as a wall, a ceiling, or a railing. Example fixtures and accessories that may be attached to the fixtures are described below with reference to the Example Fixtures & Lighting Accessories section.

The lighting device 102 may comprise a plurality of lens assemblies 106 disposed over the LEDs. The lens assemblies 106 may each comprise at least one optical element such as a lens, a reflect, and/or a scattering element. The lens assemblies 106 may change at least one characteristic of the light emitted from the LEDs. For example, the LEDs may be phosphor converted LEDs that emit light with an angular CCT deviation. In this example, the lens assemblies 106 may receive light from the LED and make the color temperature of the light more uniform. Additionally (or alternatively), the lens assembly 106 may adjust a light distribution pattern of the LED. For example, the lens assembly 106 may create a circular beam of light or an oblong beam of light. Example implementations of the lens assembly 106 are described in detail in U.S. Patent Publication No. 2017/0261186, titled "LIGHTING SYSTEM WITH LENS ASSEMBLY," published on Sep. 14, 2017, which is hereby incorporated herein by reference in its entirety.

It should be appreciated that various alterations may be made to the lighting system 100 without departing from the scope of the present disclosure. For example, the lens assemblies 106 may be removed and, thereby, directly expose the LEDs under the lens assemblies 106. An example of such a lighting system without lens assemblies is described in U.S. Patent Publication No. 2016/0201861, titled "FLEXIBLE STRIP LIGHTING APPARATUS AND METHODS," published on Jul. 14, 2016, which is hereby incorporated herein by reference in its entirety.

Figure 2A:
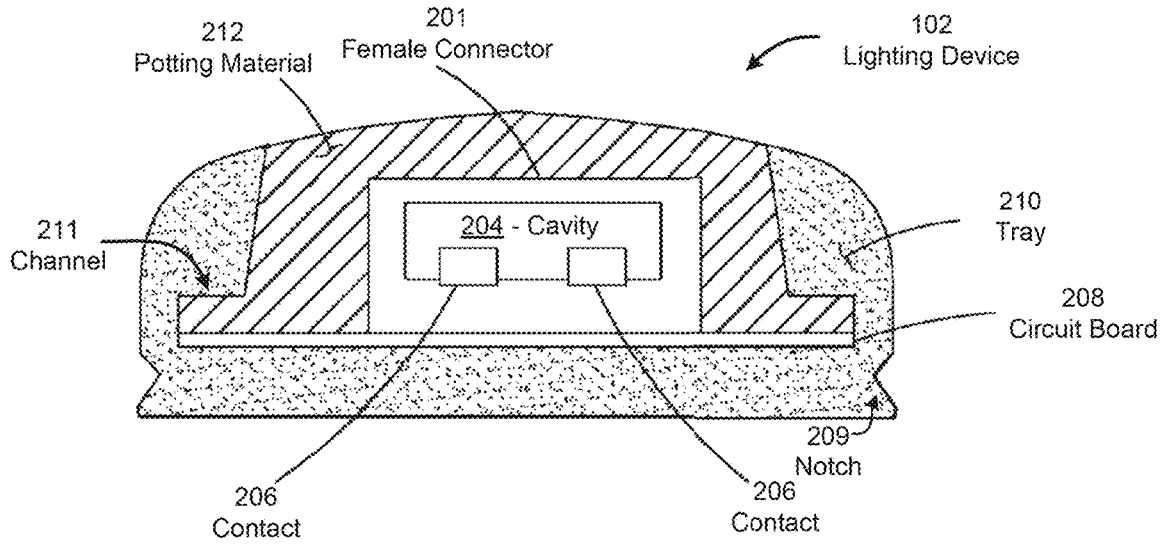
FIG. 2A shows a front view of the example lighting system of FIG. 1A, according to some embodiments of the technology described herein.
Figure 2B:
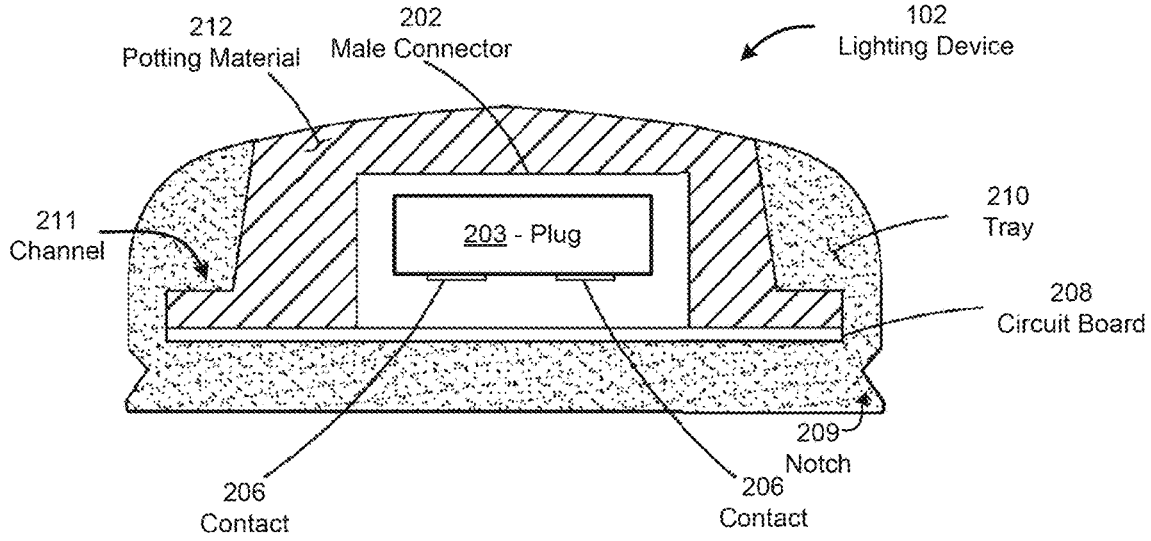
FIG. 2B shows a rear view of the example lighting system of FIG. 1A, according to some embodiments of the technology described herein.

FIGS. 2A and 2B show front and rear views, respectively, of the lighting device 102. As shown, the lighting device 102 comprises a tray 210 with a channel 211 into which a circuit board 208 may be inserted. The tray 210 also comprises a notch 209 on an outer lateral surface of the tray 210 that may be employed to, for example, removably couple one or more devices to the lighting device 102 (e.g., lighting accessories, lens assemblies, etc.). The circuit board 208 may be, for example, a flexible PCB to allow the lighting device 102 to bend without breaking. Once the circuit board 208 has been inserted into the tray 210, potting material 212 may be added to the lighting device 102 to fill the tray 210. Thereby, the potting material 212 may be contact with the circuit board 208, the tray 210, lens assemblies 106, and/or the connector 104 (implemented as female connector 201 or male connector 202). The potting material 212 and/or the tray 210 may be constructed from an elastomer. Thereby, the circuit board 208 may be at least partially encapsulated with an elastomer. For example, both the potting material 212 and the tray 210 may be constructed from silicone. It should be appreciated that the potting material 212 may have a different material composition than the tray 210.

The circuit board 208 may be electrically coupled to other components using the connector 104 that may be implemented as a female connector 201 or a male connector 202. The female connector 201 comprises a cavity 204 with multiple contacts 206. The cavity 204 may be configured to receive a plug of a corresponding male connector (e.g., male connector 202). The male connector 202 may comprise a plug 203 with contacts 206 disposed on a bottom surface of the plug 203. The plug 203 may be constructed to be inserted into a female connector (e.g., female connector 201).

Figure 3A:
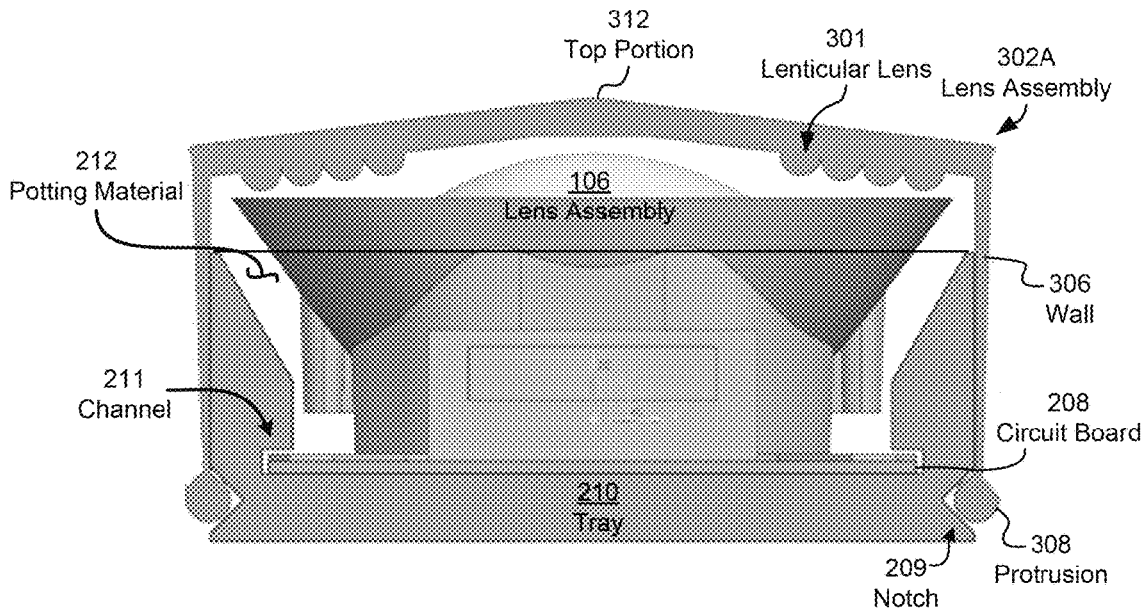
FIG. 3A shows a cross-section view of an example lighting system, according to some embodiments of the technology described herein.

In some embodiments, the lighting system may further comprise a lens assembly (e.g., separate and distinct from any lens assembly integrated with the lighting device) that includes a lenticular lens that is disposed above the lighting device. A cross-sectional view of such a lighting system is shown in FIG. 3A. As shown, the lighting system comprises a lighting device formed by the tray 210 that includes channel 211 and notch 209, circuit board 208, a lens assembly 106 disposed over an LED mounted to the circuit board 208, and potting material 212 that is in contact with the lens assembly 304A, the circuit board 208, and the tray 210. The lighting system further comprises a lens assembly 302A that is removably coupled to the lighting device using the notch 209 on the outer lateral surface of the tray 210. As shown, the lens assembly 302A includes a top portion 312 that is disposed above the lighting device and includes at least one lenticular lens 301 that runs along the length of the lighting device (e.g., parallel to a line that intersects the LEDs mounted to the circuit board 208), walls 306 that extend from the top portion 312 towards the lighting device and include an inner surface that faces the outer lateral surface of the tray 210 and an outer surface that faces away from the outer lateral surface of the tray 210, and a protrusion 308 that is attached to the wall 306 and configured to engage the notch 209 to removably couple the lens assembly 302A to the lighting device. As shown, the lenticular lenses 301 on the top portion 312 may be arranged into two separate arrays including a first array that is disposed on a first side of the lighting device and a second array disposed on a second side of the lighting device that is opposite the first side. These arrays may be separated from each other by a distance that is, for example, equal to at least a threshold percentage of the width of the lighting device such as 10 percent (e.g., if the width of the lighting device is 3 inches, the arrays may be separated by at least 0.3 inches), 15 percent, 20 percent, 25 percent, etc.

Figure 3B:
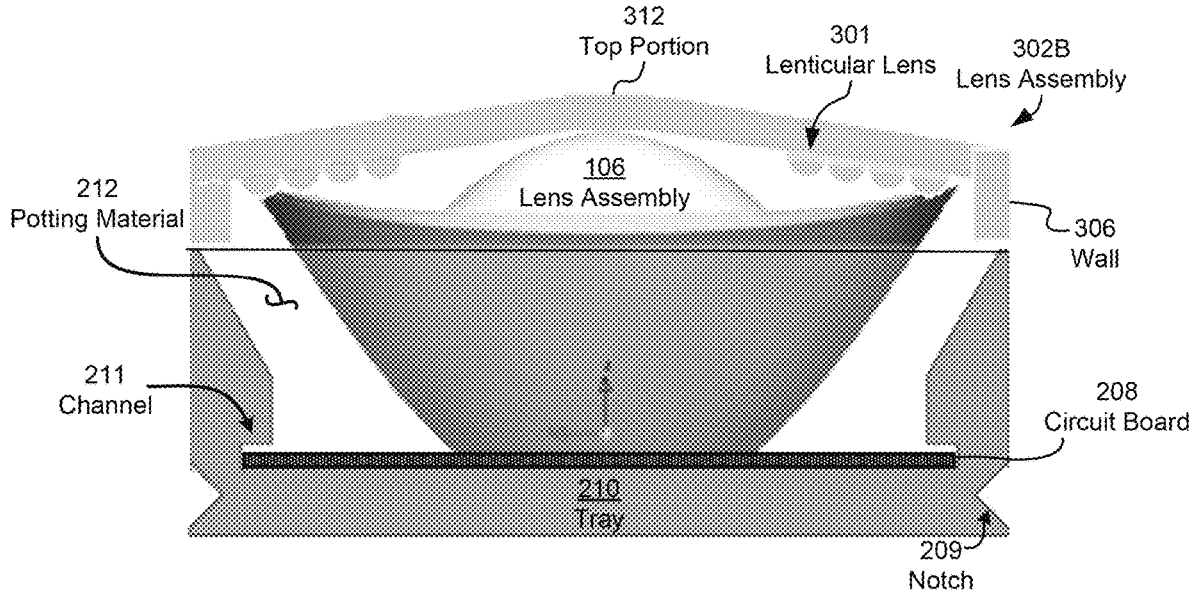
FIG. 3B shows a cross-section view of another example lighting system, according to some embodiments of the technology described herein.

In some embodiments, the lens assembly 302A may be coupled to the lighting device using a mechanism separate and apart from the notch 209. For example, the lens assembly may be attached to a top surface of the lighting device as shown by lens assembly 302B in FIG. 3B. As shown, the lens assembly 302B has shortened walls 306 that contact the top surface of the lighting device. The walls 306 may be attached to the top surface of the lighting device using, for example, an adhesive.

It should be appreciated that the lens assemblies 302A and/or 302B may be constructed from any of a variety of materials. For example, the lens assemblies 302A and/or 302B may be constructed from one or more of the following materials: plastic (e.g., acrylic or polycarbonate), glass, and silicone. Further, the lens assemblies 302A and/or 302B may be monolithic elements.

Example Fixtures & Lighting Accessories

The lighting devices described above may be employed in any of a variety of lighting applications. Example lighting applications for the lighting devices disclosed herein include, by are not limited to, recessed slot lighting, overhead lighting, display lighting, hallway lighting, stairway lighting, architectural lighting, decorative lighting, outdoor lighting, and accent lighting. In some of these lighting applications, a fixture may be employed to mount the lighting device to a structure such as a ceiling, an interior wall, an exterior wall, a floor, an outdoor walkway, or a railing using various fixtures. These fixtures may further enable one or more lighting accessories to be used in combination with the lighting device to change a characteristic of the light such as a color temperature and/or a distribution pattern.

Figure 4A:
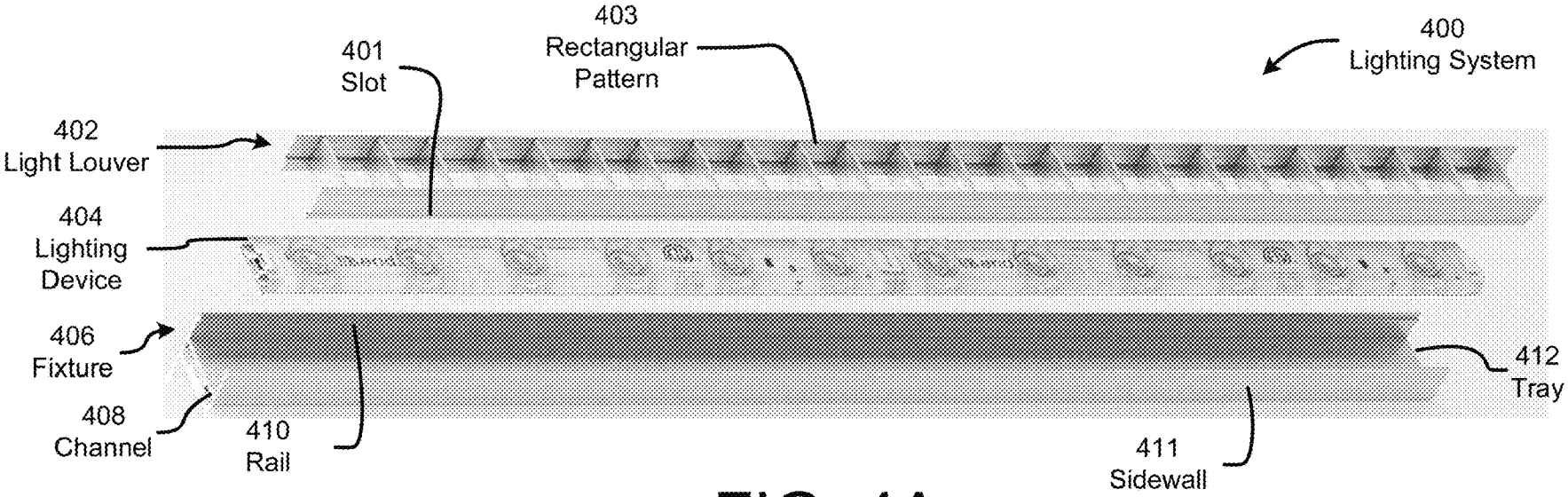
FIG. 4A shows an exploded view of an example lighting system with a fixture and a lighting accessory, according to some embodiments of the technology described herein.
Figure 4B:
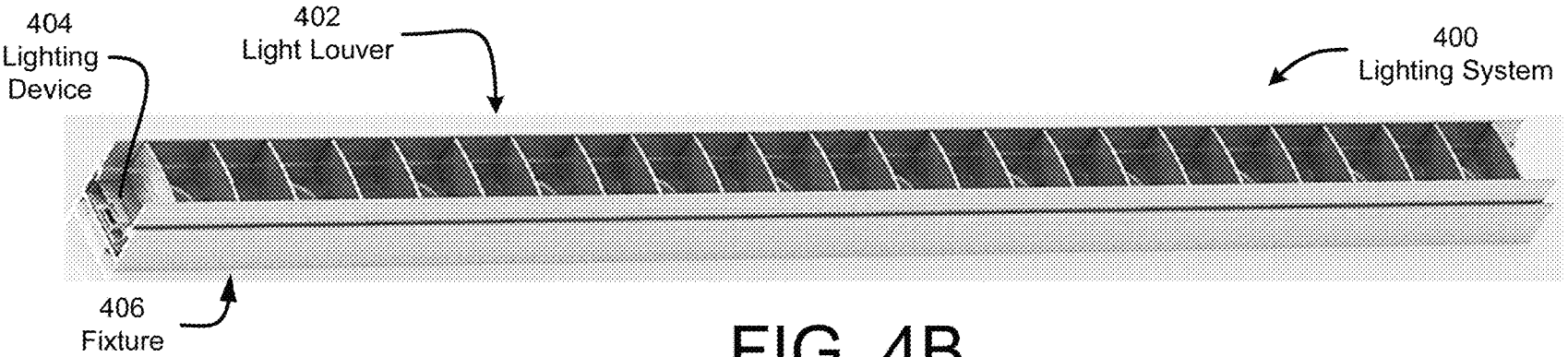
FIG. 4B shows an assembled view of the example lighting system with a fixture and a lighting accessory in FIG. 4A, according to some embodiments of the technology described herein.

An example lighting system including such a fixture is shown in FIGS. 4A and 4B by lighting system 400. As shown, the lighting system 400 comprises a fixture 406 that receives a lighting device 404. The lighting device 404 may be any of the above described lighting devices (e.g., lighting device 102) with or without the lens assemblies shown in FIGS. 3A and 3B. The fixture 406 comprises a tray 412 that has a flat surface for the lighting device 404 to attach to (e.g., using an adhesive) with sidewalls 411 on either side of the flat surface. The tray 412 comprises a channel 408 on a bottom surface opposite the flat surface for the lighting device 404 to facilitate mounting of the fixture 400 to a structure. The tray 412 also comprises a rail 410 to removably couple to lighting accessories such as a light louver 402 with a rectangular pattern 403 that engages the rail using a slot 401. The light louver 402 may change a light distribution of light from the lighting device 404.

Figure 5A:
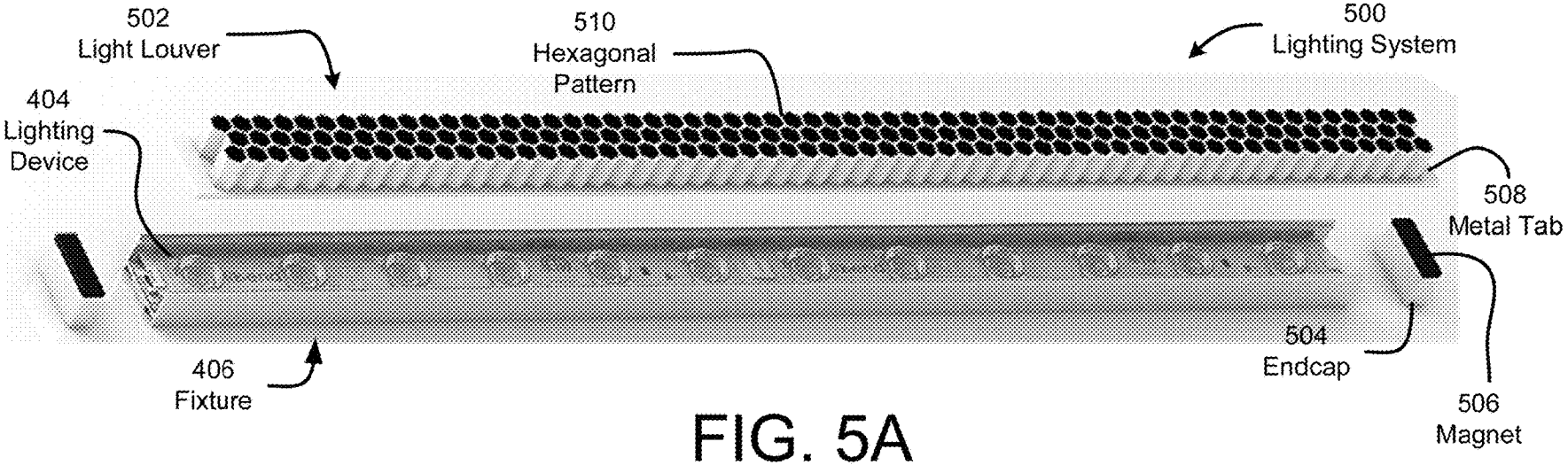
FIG. 5A shows an exploded view of an example lighting system with a fixture and a lighting accessory, according to some embodiments of the technology described herein.
Figure 5B:
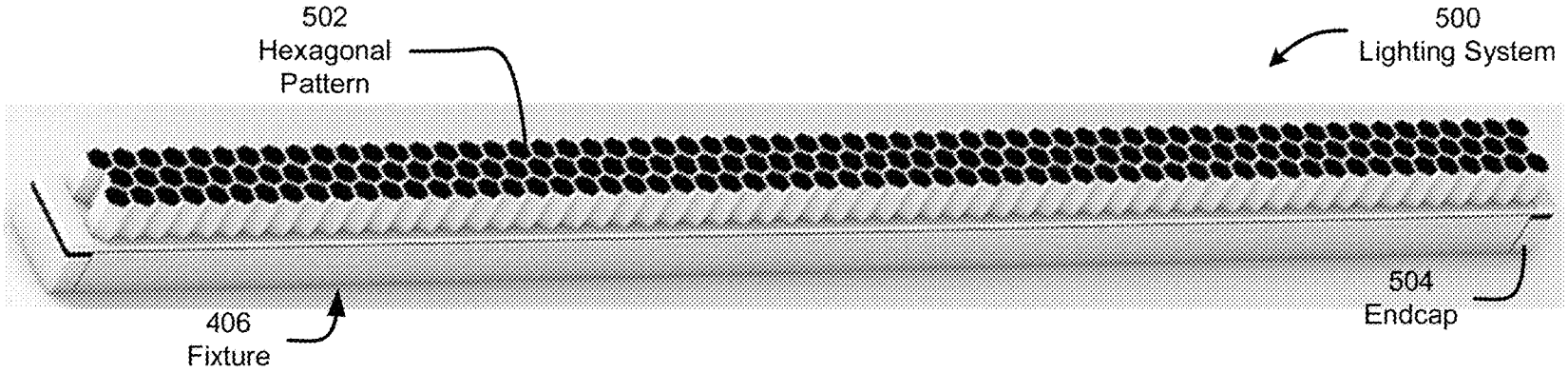
FIG. 5B shows an assembled view of the example lighting system with a fixture and a lighting accessory in FIG. 5A, according to some embodiments of the technology described herein.

FIGS. 5A and 5B show a lighting system 500 with another example lighting accessory that may be removably coupled to the fixture 406. As shown, the lighting system 500 comprises a light louver 502 with a hexagonal pattern 510 that removably couples to the fixture 406 over the lighting device 404. The light louver 502 removably couples to the fixture 406 using endcaps 504 with magnets 506 that are attracted to metal tabs 508 in the light louver 502. The endcaps 504 may removably couple to the ends of fixture 406 and the magnets 506 in the endcaps 504 may be attracted to the metal tabs 508 in the light louver 502 and, thereby, hold the light louver 502 in place.

Figure 6A:
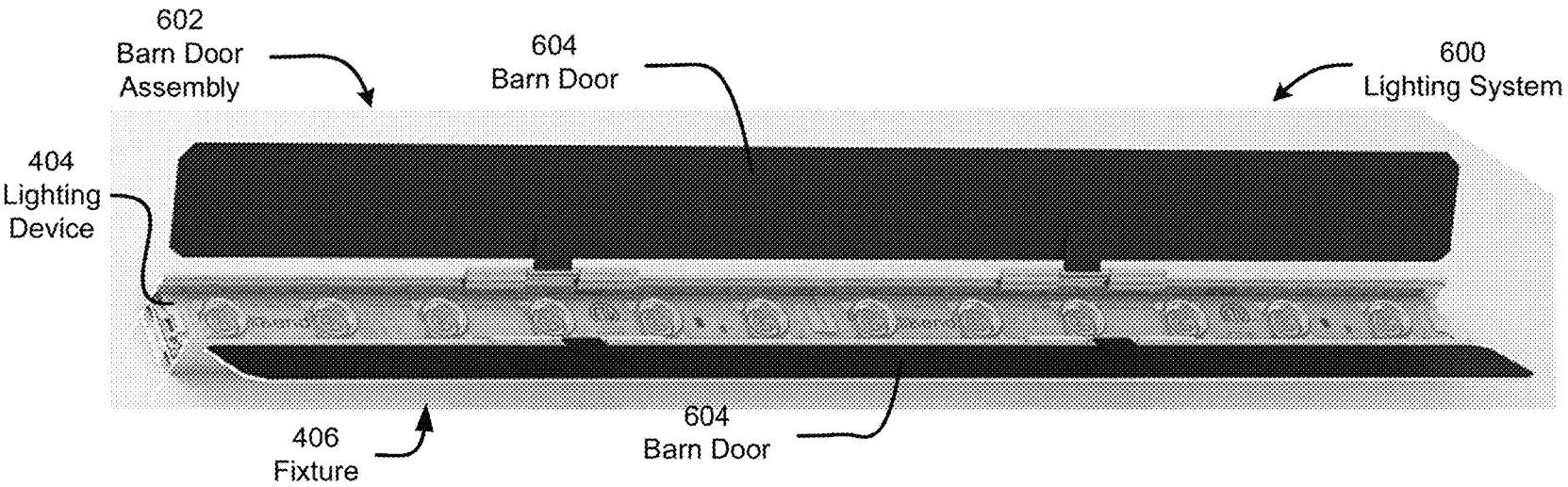
FIGS. 6A and 6B show perspective views of an example lighting system with a fixture and a lighting accessory, according to some embodiments of the technology described herein.
Figure 6B:
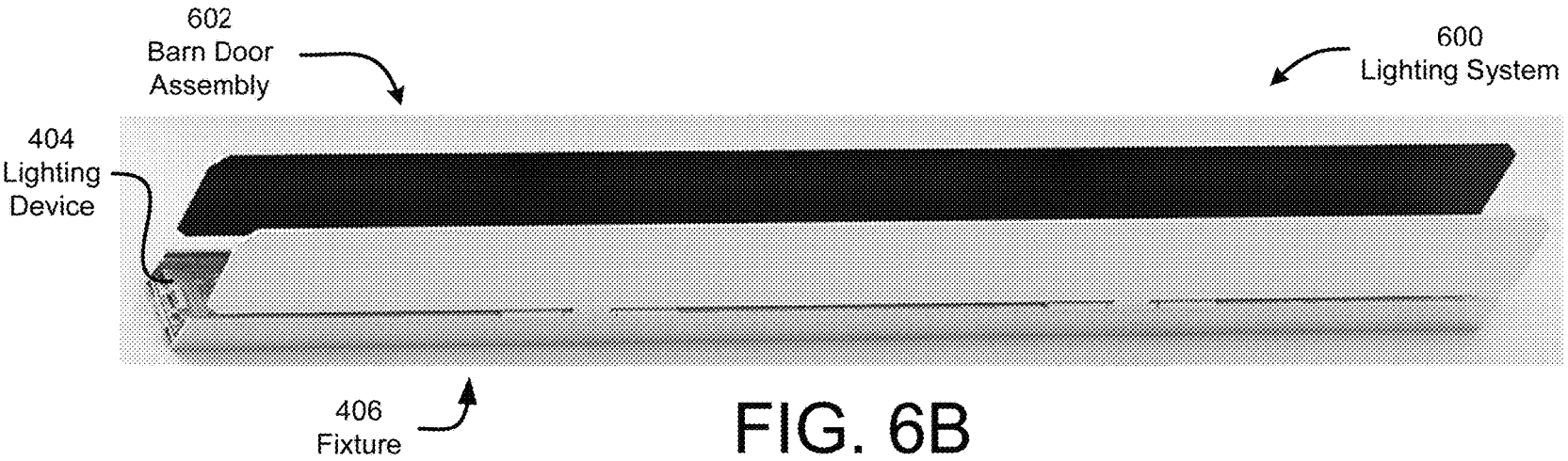

FIGS. 6A and 6B show a lighting system 600 with another example lighting accessory that may be removably coupled to the fixture 406. As shown, the lighting system 600 comprises a barn door assembly 602 with barn doors 604 that are removably and rotatably coupled to the fixture 406 over the lighting device 404. The position of the barn doors 604 may be adjusted to change a distribution of light from the lighting system 600. For example, the barn doors 604 may be rotated to create shadows in desired locations.

Figure 7:
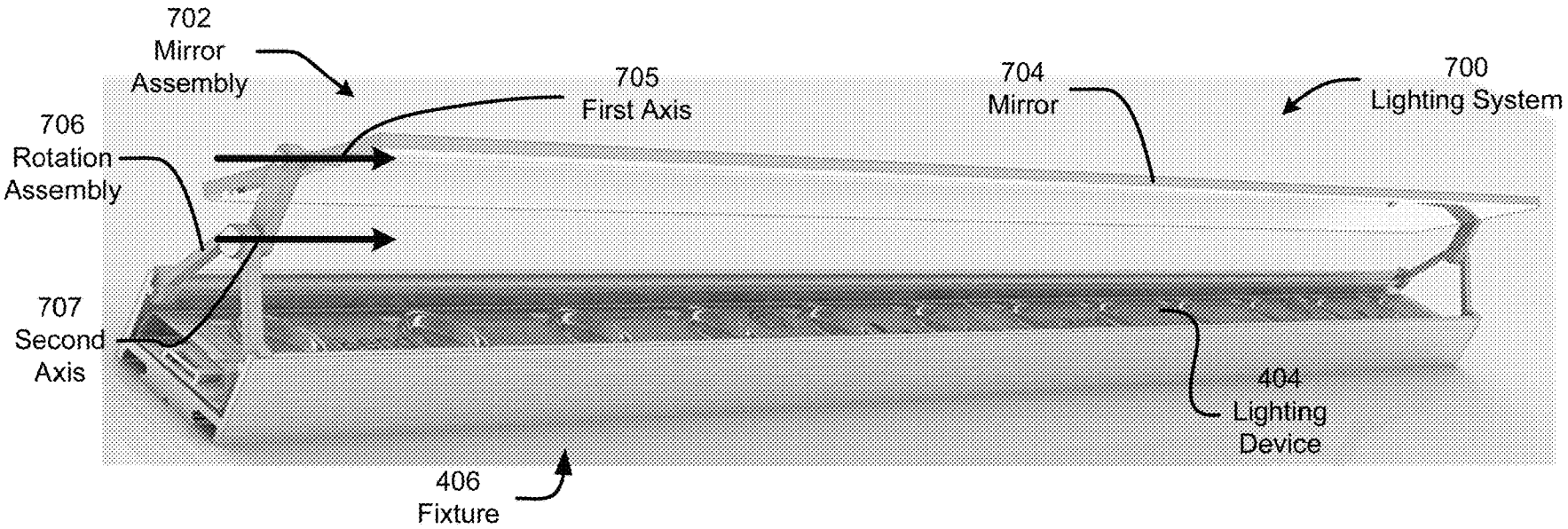
FIG. 7 shows a perspective view of an example lighting system with a fixture and a lighting accessory, according to some embodiments of the technology described herein.

FIG. 7 shows a lighting system 700 with another example lighting accessory that may be removably coupled to the fixture 406. As shown, the lighting system 700 comprises a mirror assembly 702 with a mirror 704 that is removably and rotatably coupled to the fixture 406 over the lighting device 404 by a rotation assembly 706. The rotation assembly allows the mirror 704 to be rotated about two axes 705 and 707 that are parallel to each other, the lighting device 404 and the fixture 406. The position of the mirror 704 may be adjusted by rotating the mirror about the first or second axes 705 and 707, respectively, to change a distribution of light from the lighting system 700. For example, the mirror 702 may be rotated to change a direction of the light from the lighting system 700.

Figure 8:
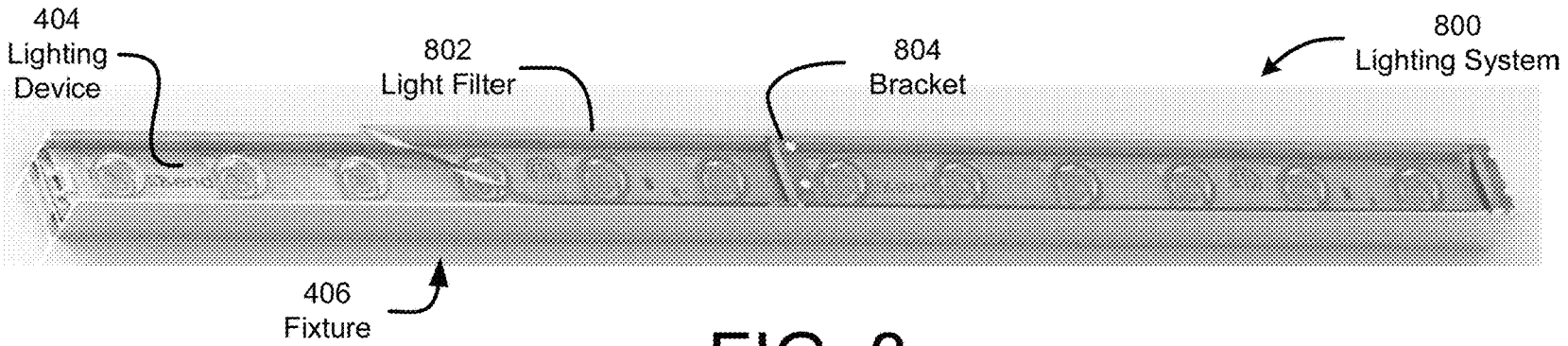
FIG. 8 shows a perspective view of an example lighting system with a fixture and a lighting accessory, according to some embodiments of the technology described herein.

FIG. 8 shows a lighting system 800 with another example lighting accessory that may be removably coupled to the fixture 406. As shown, the lighting system 800 comprises a light filter 802 that is removably coupled to the fixture 406 over the lighting device 404 by a bracket 804. The light filter 802 may be adjusted to change a characteristic of the light from the lighting system such as a CCT value. For example, the light filter 802 may comprise a pigmented material (e.g., a pigmented silicone) that makes the light from the lighting system 800 warmer (e.g., lowers the CCT value of the light from the lighting device 404).

Figure 9:
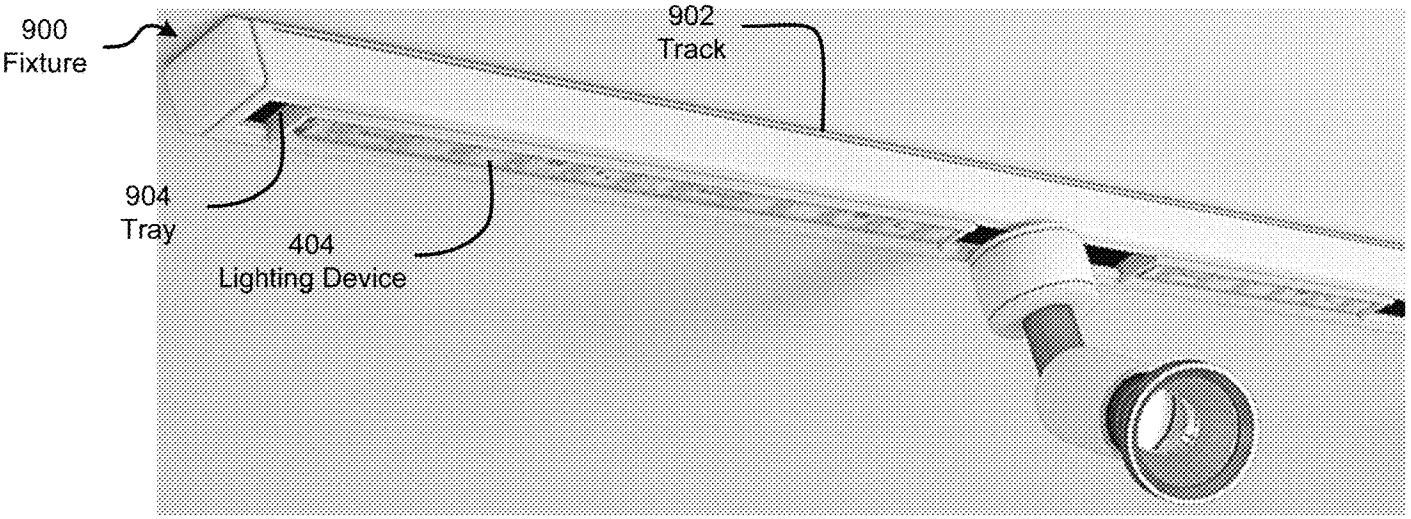
FIG. 9 shows a perspective view of an example fixture for a lighting device, according to some embodiments of the technology described herein.

It should be appreciated that fixtures other than the fixture 406 may be employed to mount the lighting device 404 to a structure. Another example fixture is shown in FIG. 9 by fixture 900 for the lighting device 404. As shown, the fixture 900 comprises a track 902 that may be attached to a structure (e.g., attached by using screws) and a tray 904 that slides along the track 902 and receives the lighting device 404. The lighting device 404 may be held in the tray 904 using, for example, an adhesive.

Figure 10:
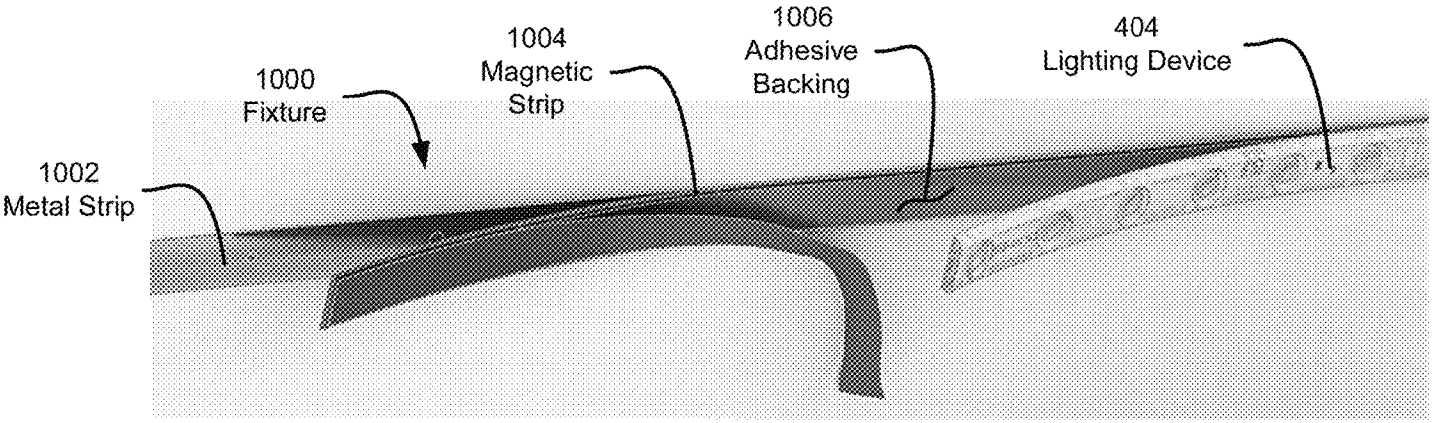
FIG. 10 shows a perspective view of an example fixture for a lighting device, according to some embodiments of the technology described herein.

FIG. 10 shows another example fixture 1000 for the lighting device 404. The fixture 1000 comprises a metal strip 1002 that may be attached to a structure (e.g., attached by using screws) and a magnetic strip 1004 with an adhesive backing 1006. The adhesive backing 1006 may hold the lighting device 404 to the magnetic strip 1004. In turn, the magnetic strip 1004 may be attracted to the metal strip 1002 and, thereby, hold the lighting device 404 in place.

Figure 11A:
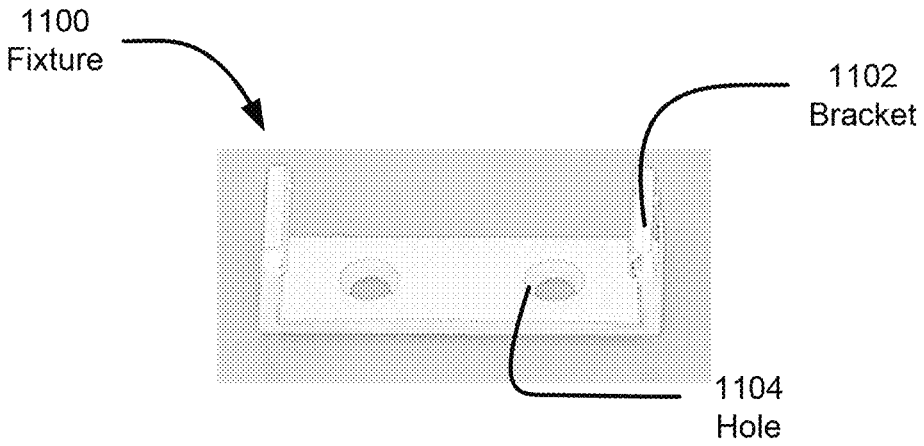
FIG. 11A shows a perspective view of an example fixture for a lighting device, according to some embodiments of the technology described herein.
Figure 11B:
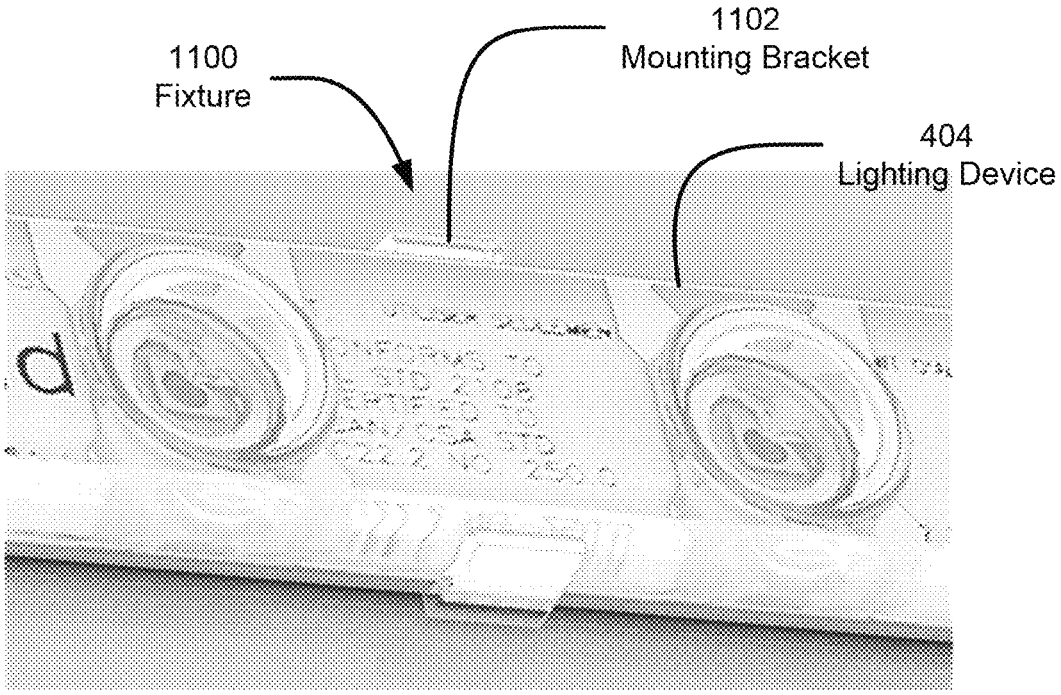
FIG. 11B shows a perspective view of the example fixture for a lighting device shown in FIG. 11A with a lighting device, according to some embodiments of the technology described herein.

FIGS. 11A and 11B show another example fixture 1100 for the lighting device 404. The fixture 1100 comprises a bracket 1102 with two holes 1104 that may be attached to a structure by, for example, inserting screws through the holes 1104 and into the structure. The bracket 1102 comprises sidewalls that are shaped to conform to the contours of the lighting device 404. Thereby, the bracket 1102 may hold the lighting device 404 in place.

Figure 12A:
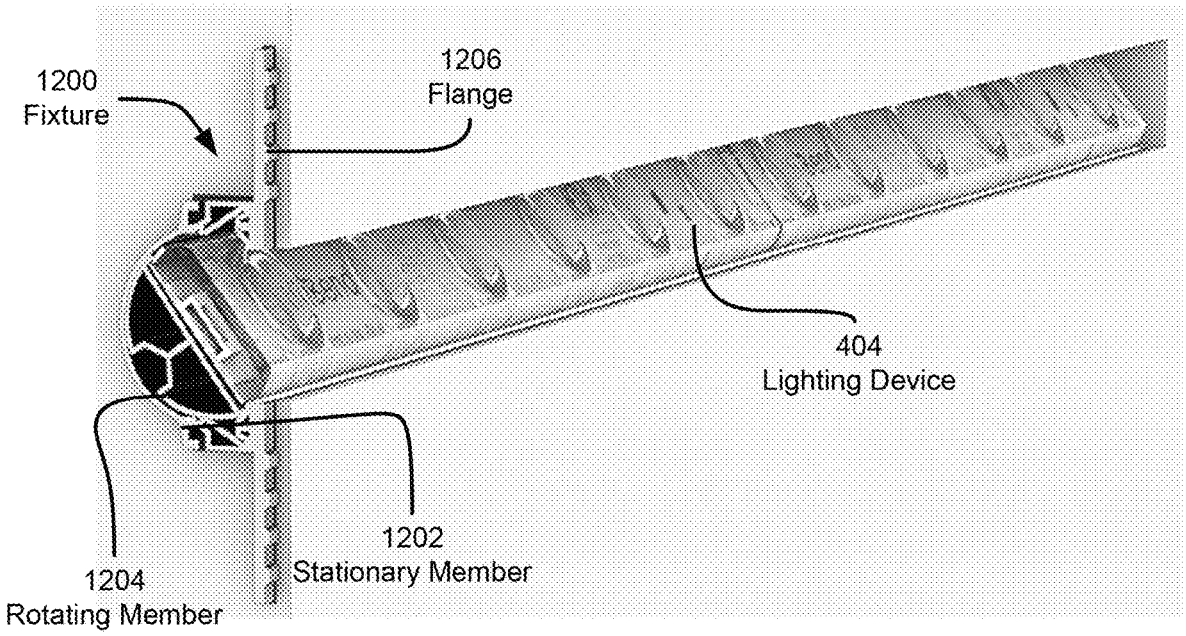
FIGS. 12A and 12B show perspective views of an example fixture for a lighting device, according to some embodiments of the technology described herein.
Figure 12B:
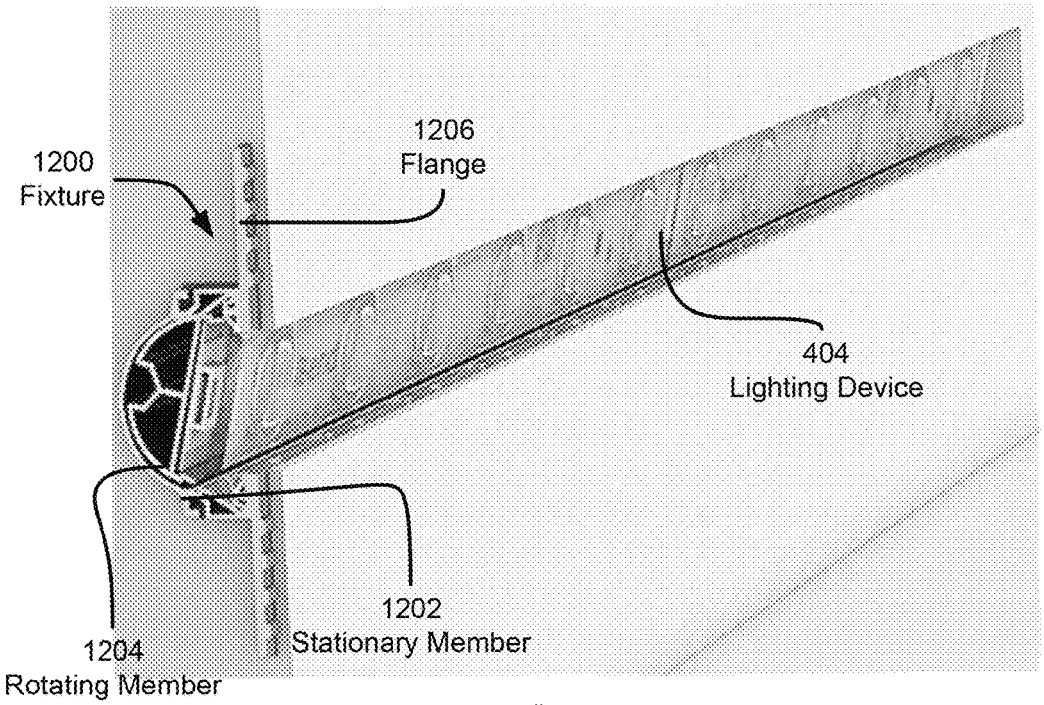

FIGS. 12A and 12B show another example fixture 1200. As shown, the fixture 1200 is configured to mount to a wall or a ceiling. The fixture 1200 comprises a flange 1206 that is inserted into the wall and is coupled to a stationary member 1202. The stationary member 1202 receives a rotating member 1204 and allows the rotating member 1204 to rotate along an interface between the stationary member 1202 and the rotating member 1204. The lighting device 404 may be attached to a flat surface of the rotating member 1204 using, for example, an adhesive. Thereby, the direction of the light from the lighting device 404 may be changed by rotating the rotating member 1204.

Figure 13A:
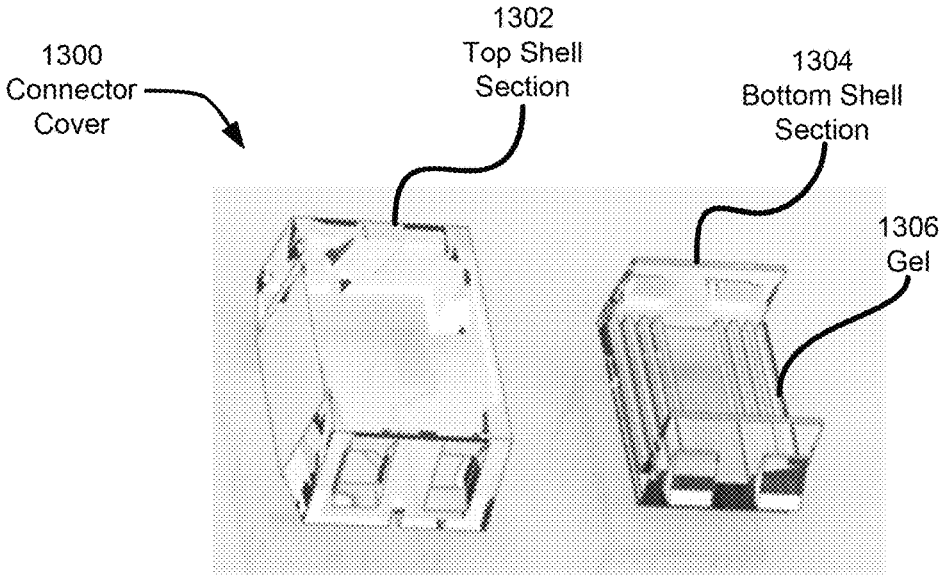
FIG. 13A shows a perspective view of a connector cover for a lighting device, according to some embodiments of the technology described herein.
Figure 13B:
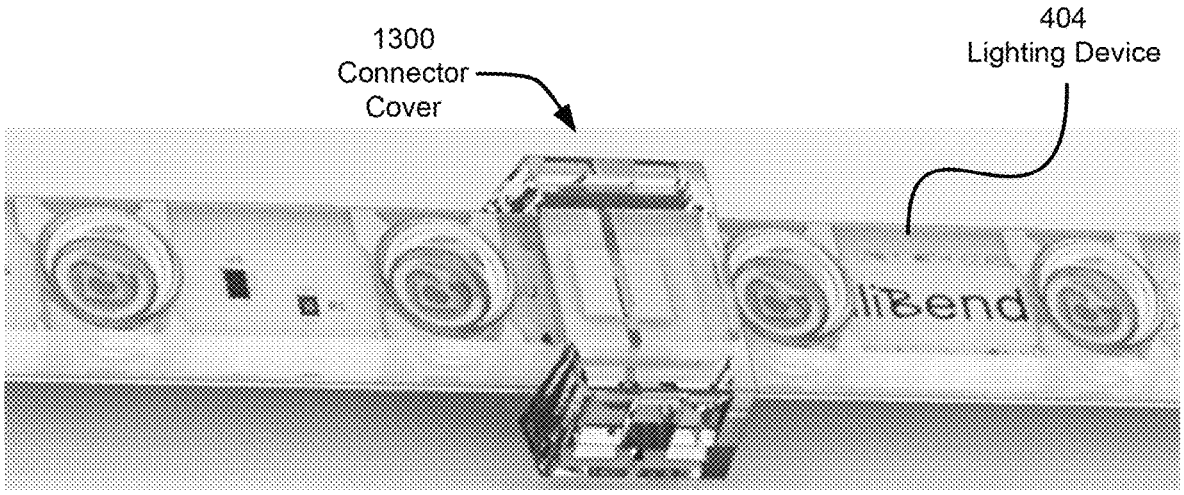
FIG. 13B shows a perspective view of the connector cover of FIG. 13A with a lighting device, according to some embodiments of the technology described herein.

In some embodiments, the lighting device 404 may be installed outdoors. For example, the lighting device 404 may be installed along a walkway or on an exterior face of a building. In these applications, it may be desirably to make the connections between the lighting device 404 and other devices such as power adapters and other lighting devices 404 water resistant and/or waterproof. FIGS. 13A and 13B show a connector cover 1300 configured to make a connection between two lighting devices 404 water resistant (e.g., achieve an IP67 water resistance rating). As shown, the connector cover 1300 comprises a top shell section 1302 that may connect to a bottom shell section 1304. For example, the top and bottom shell sections 1302 and 1304, respectively, may snap together to capture (e.g., entirely capture) a seam between the two lighting devices 404 using snap fit connectors such as annular snap-fit connectors, cantilever snap-fit connectors, or torsional snap-fit connectors. The top and/or bottom shell sections 1302 and 1304, respectively, may comprise a gel 1306 that creates a seal between the respective section of the connector cover 1300 and a lighting device 404 to impede water from coming in contact with the connector of the lighting device 404. The gel 1306 may be, for example, a silicone gel.

Figure 14A:
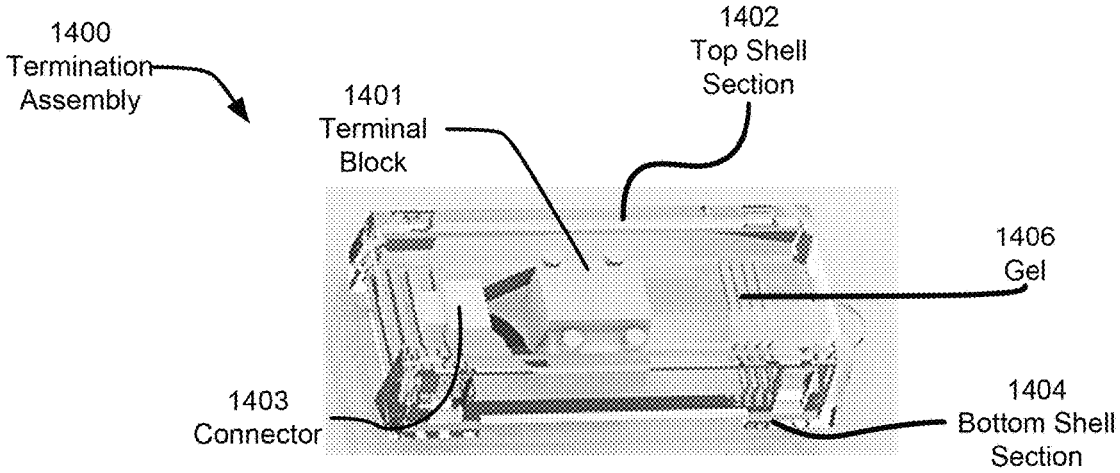
FIG. 14A shows a perspective view of an example termination assembly for a lighting device, according to some embodiments of the technology described herein.
Figure 14B:
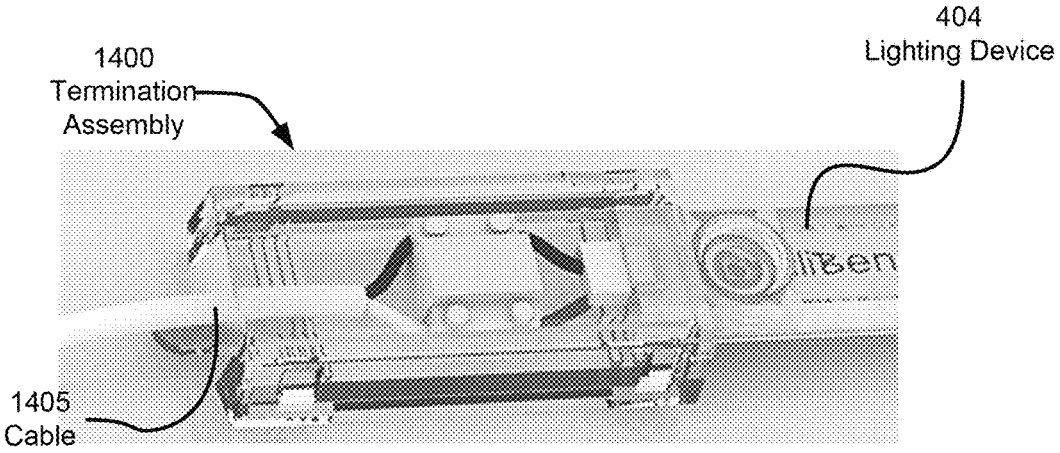
FIG. 14B shows a perspective view of the example termination assembly of FIG. 14A with a lighting device, according to some embodiments of the technology described herein.

FIGS. 14A and 14B show an example termination assembly 1400 that is configured to make a connection between a lighting device 404 and a cable 1405 water resistant (e.g., achieve an IP67 water resistance rating). As shown, the termination assembly 1400 comprises a top shell section 1402 that may connect to a bottom shell section 1404 and capture a terminal block 1401 there between. For example, the top and bottom shell sections 1402 and 1404, respectively, may snap together using snap fit connectors such as annular snap-fit connectors, cantilever snap-fit connectors, or torsional snap-fit connectors. The top and/or bottom shell sections 1402 and 1404, respectively, may comprise a gel 1406 that creates a seal between the respective section of the termination assembly 1400 and the lighting device 404 or cable 1405 to impede water from coming in contact with the connector of the lighting device 404. The gel 1406 may be, for example, a silicone gel. The terminal block 1401 may electrically couple the cable 1404 to the connector 1403 that plugs into a connector on the lighting device 404. Thereby, an electrical connection may be formed between the cable 1405 and the lighting device 404. The cable 1405 may comprise, for example, a wire with a wire gauge of 18 (measured using the American wire gauge (AWG) system) with a non-metallic sheath. The cable 1405 may electrically couple the lighting device 104 to, for example, a power supply.

Various aspects of the present disclosure may be used alone, in combination, or in a variety of arrangements not specifically discussed in the embodiments described in the foregoing and is therefore not limited in its application to the details and arrangement of components set forth in the foregoing description or illustrated in the drawings. For example, aspects described in one embodiment may be combined in any manner with aspects described in other embodiments.

Use of ordinal terms such as "first," "second," "third," etc., in the claims to modify a claim element does not by itself connote any priority, precedence, or order of one claim element over another or the temporal order in which acts of a method are performed, but are used merely as labels to distinguish one claim element having a certain name from another element having a same name (but for use of the ordinal term) to distinguish the claim elements.

The terms "approximately," "about," and "substantially" may be used to mean within ±20% of a target value in some embodiments, within ±10% of a target value in some embodiments, within ±5% of a target value in some embodiments, and yet within ±2% of a target value in some embodiments. The terms "approximately," "about," and "substantially" may include the target value.

Also, the phraseology and terminology used herein is for the purpose of description and should not be regarded as limiting. The use of "including," "comprising," or "having," "containing," "involving," and variations thereof herein, is meant to encompass the items listed thereafter and equivalents thereof as well as additional items.

Having described above several aspects of at least one embodiment, it is to be appreciated various alterations, modifications, and improvements will readily occur to those skilled in the art. Such alterations, modifications, and improvements are intended to be object of this disclosure. Accordingly, the foregoing description and drawings are by way of example only.

What is claimed is:

1. A lighting system, comprising:

a strip lighting device having a first tray, a circuit board disposed in the first tray, a light emitting diode (LED) mounted to the circuit board, and a potting material encapsulating at least part of the circuit board and being in contact with the first tray;

a mounting fixture configured to receive the strip lighting device, the mounting fixture having a second tray including a surface for receiving the strip lighting device and including a plurality of sidewalls that enclose the strip lighting device within the second tray; and a lighting accessory configured to removably couple to the mounting fixture enclosing the strip lighting device and configured to change a characteristic of light being emitted from the strip lighting device;

wherein the lighting accessory includes a mirror assembly configured to change a distribution of the light being emitted from the strip lighting device and including a mirror that is configured to rotate about at least one axis to change the distribution of the light being emitted from the strip lighting device.

2. The lighting system of claim 1, wherein the strip lighting device includes a lens assembly disposed over the LED, the lens assembly being configured to removably couple to the strip lighting device, the lens assembly including a lens and being configured to change another characteristic of the light being emitted from the strip lighting device.

3. The lighting system of claim 2, wherein the lens assembly further includes, being disposed above the strip lighting device, a reflector or a light scattering element.

4. The lighting system of claim 2, wherein the first tray includes a notch on an outer lateral surface of the first tray and wherein the lens assembly is configured to removably couple to the strip lighting device using the notch.

5. The lighting system of claim 4, wherein the lens assembly includes: a top portion including the lens; a sidewall that extends from the top portion and has an inner surface that faces toward the outer lateral surface of the first tray and an outer surface that faces away from the outer lateral surface of the first tray; and a protrusion on the sidewall that is configured to removably engage the notch on the outer lateral surface of the first tray.

6. The lighting system of claim 2, wherein the lens assembly is configured to change a color temperature, an angular correlated color temperature deviation, or another distribution of the light being emitted from the strip lighting device.

7. The lighting system of claim 1, including another lighting accessory configured to removably couple to the mounting fixture enclosing the strip lighting device and configured to change another characteristic of the light being emitted from the strip lighting device, wherein the another lighting accessory includes: a light filter configured to change a color temperature of the light being emitted from the strip lighting device, or a light louver configured to change another distribution of the light being emitted from the strip lighting device.

8. The lighting system of claim 1, including another lighting accessory configured to removably couple to the mounting fixture enclosing the strip lighting device and configured to change another characteristic of the light being emitted from the strip lighting device, wherein the another lighting accessory includes comprises a barn door assembly configured to change another distribution of the light being emitted from the strip lighting device and including a plurality of barn doors rotatably coupled to the mounting fixture.

9. The lighting system of claim 1, wherein the second tray includes comprises a rail that extends from at least one of the plurality of sidewalls and being configured to removably couple to the lighting accessory.

10. A lighting system, comprising:

a strip lighting device having a first tray, a circuit board disposed in the first tray, a light emitting diode (LED) mounted to the circuit board, a lens assembly including a lens and being disposed over the LED, the lens assembly configured to removably couple to the strip lighting device being and configured to change a at least one characteristic of light being emitted from the strip lighting device, and a potting material encapsulating at least part of the circuit board and being in contact with the first tray; and a mounting fixture configured to receive the strip lighting device, the mounting fixture having a second tray including a surface for receiving the strip lighting device and including a plurality of sidewalls that enclose the strip lighting device within the second tray; and a lighting accessory configured to removably couple to the mounting fixture enclosing the strip lighting device and configured to change another characteristic of the light being emitted from the strip lighting device.

11. The lighting system of claim 10, wherein the first tray includes a notch on an outer lateral surface of the first tray and wherein the lens assembly is configured to removably couple to the strip lighting device using the notch.

12. The lighting system of claim 11, wherein the lens assembly includes: a top portion including the lens; a sidewall that extends from the top portion and has an inner surface that faces toward the outer lateral surface of the first tray and an outer surface that faces away from the outer lateral surface of the first tray; and a protrusion on the sidewall that is configured to removably engage the notch on the outer lateral surface of the first tray.

13. The lighting system of claim 10, wherein the lens assembly further includes, being disposed above the strip lighting device, a reflector or a light scattering element.

14. The lighting system of claim 10, wherein the lens assembly is configured to change a color temperature, an angular correlated color temperature deviation, or a distribution of the light being emitted from the strip lighting device.

15. The lighting system of claim 10, wherein the lighting accessory includes a mirror assembly including a mirror that is configured to rotate about at least one axis to change a distribution of the light being emitted from the strip lighting device.

16. The lighting system of claim 10, wherein the lighting accessory includes: a light filter configured to change a color temperature of the light being emitted from the strip lighting device, or a light louver configured to change a distribution of the light being emitted from the strip lighting device.

17. The lighting system of claim 10, wherein the lighting accessory includes a barn door assembly including a plurality of barn doors rotatably coupled to the mounting fixture configured to change a distribution of light being emitted from the strip lighting device.

18. The lighting system of claim 10, wherein the second tray includes a rail that extends from at least one of the plurality of sidewalls and being configured to removably couple to the lighting accessory.

19. The lighting system of claim 1, wherein the potting material includes an elastomer.

20. The lighting system of claim 10, wherein the potting material includes an elastomer.

* * * * *